United States Patent [19]

Benzur

[11] Patent Number: 5,013,086

[45] Date of Patent: May 7, 1991

[54] ROCKER

[76] Inventor: Yoram Benzur, 34 Ha-arbah Street, Pisgat Zev, Jerusalem, Israel

[21] Appl. No.: 349,863

[22] Filed: May 10, 1989

[30] Foreign Application Priority Data

May 15, 1988 [IL] Israel ..... 86385

[51] Int. Cl.[5] ..... A47D 1/08

[52] U.S. Cl. ..... 297/272; 5/107; 297/133; 297/270

[58] Field of Search ..... 297/272, 270, 633; 5/107

[56] References Cited

U.S. PATENT DOCUMENTS

| | | | |
|---|---|---|---|
| 149,178 | 3/1874 | Wright | 297/270 |
| 153,002 | 7/1874 | Levy | 297/133 X |
| 900,548 | 10/1908 | Jenson | 297/272 |
| 1,135,266 | 4/1915 | Desper | 297/272 |
| 1,138,270 | 5/1915 | Ziegler et al. | 297/270 |
| 1,367,390 | 2/1921 | Hinson | 297/272 |
| 2,054,487 | 9/1936 | Simpson | 297/272 |
| 4,079,991 | 3/1978 | Harris | 297/272 |
| 4,126,353 | 11/1978 | Clough | 297/272 |

*Primary Examiner*—Peter R. Brown

*Attorney, Agent, or Firm*—Renner, Otto, Boisselle & Sklar

[57] ABSTRACT

A device for converting a piece of furniture into a rocker comprises two end zones bracketing an intermediate zone. The three zones are contiguous, their lower surfaces are convex, while in the upper surface of each end zone there is provided at least one recess. Such a recess is adapted to receive, in a releasable manner, one leg of a piece of furniture which has at least two legs.

8 Claims, 7 Drawing Sheets

ROCKER

FIELD OF INVENTION

The present invention relates to a rocker, in particular for the conversion of chairs, beds and baby-cribs not originally provided with rocking means.

BACKGROUND OF INVENTION

It has been known from ancient times that a gentle back-and-forth movement is conducive to the onset of sleep, particularly in infants. Modern research has shown that drowsiness is one symptom of the early stages of motion sickness, which, in its extreme form leads to nausea and eventually emesis. Motion sickness is typically induced as a result of vertical sinusoidal motion, where acceleration is in the range 0.1–0.6 g RMS, and where the frequency is in the range of 9–15 cycles per minute, a typical peak to peak vertical displacement being around 1.5 meters. Obviously, the intentional rocking of a person is meant to induce drowsiness only and no further symptoms, and while experience shows that horizontal vibration alone if continued for an extended period is effective thereto, there is also little doubt that the addition of a small vertical component of motion is beneficial and results in a much reduced requirement for horizontal amplitude and in the desired effect being achieved in a shorter time.

Modern baby cribs are, however, surprisingly deficient with regard to the provision of facilities allowing motion. Some cribs are made without provision for even horizontal movement—attempts to rock baby to sleep are liable to result in the joints of the crib framework loosening or failing. Many cribs are provided with castors; they are an improvement over plain feet, but need considerable continuous effort to achieve the required motion; they tend to scratch the floor and to generate unwanted noise. The time-honoured rocking cradle is hardly in use nowadays, probably because of the danger of instability, though it did offer the important advantage of adding a small vertical component to the acceleration experienced by its occupant, it generated little noise or wear, and once set in motion, would continue to move for a short while even when unattended.

OBJECTS OF INVENTION

It is one of the objects of the present invention to overcome the disadvantages of the prior art crib, and to provide a rocker which will enable users of prior art cribs to obtain the advantage of the rocking crib yet without the danger of instability.

It is a second object of the present invention to facilitate the conversion of the common type of chair and bed into a rockable item of furniture. A third object of the invention is to provide means whereby furniture may be readily converted from the rocking mode to the stabilized mode and vice versa.

SHORT SUMMARY OF DISCLOSURE

This the present invention achieves by providing an arcuate rail-like rocker for converting furniture having at least one pair of legs into a rocking furniture, said rocker having two end zones bracketing an intermediate zone, said zones being contiguous and having a convex lower surface, at least one recess being provided in the upper surface of each of said end zones, each of said recesses being sized to releasably receive one leg of a pair of legs of an article of furniture. The rocker has recesses, which may be provided with clamping means, for retaining furniture legs. Stabilizing legs may be provided for limiting the oscillation amplitude or for completely preventing rocking. A plurality of leg recesses in the rocker, or telescopically interconnected curved segments, may be provided for adaption to furniture of different dimensions.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

SHORT DESCRIPTION OF DRAWINGS

DETAILED DESCRIPTION OF PREFERRED EMBODIMENTS

Figure 1:
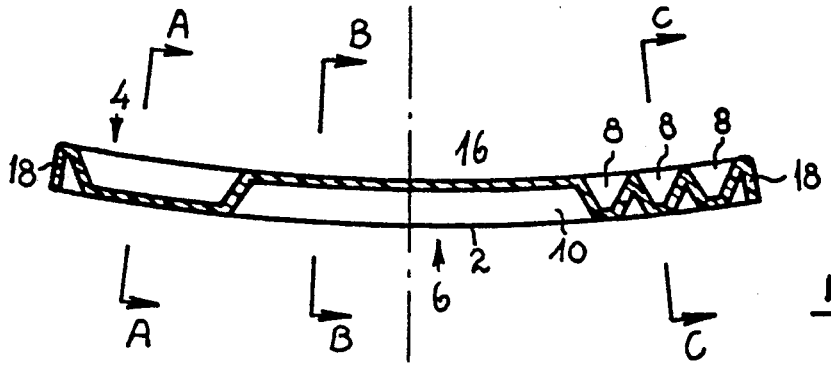
FIG. 1 is a longitudinal cross-section of the rocker according to the invention.
Figure 2:
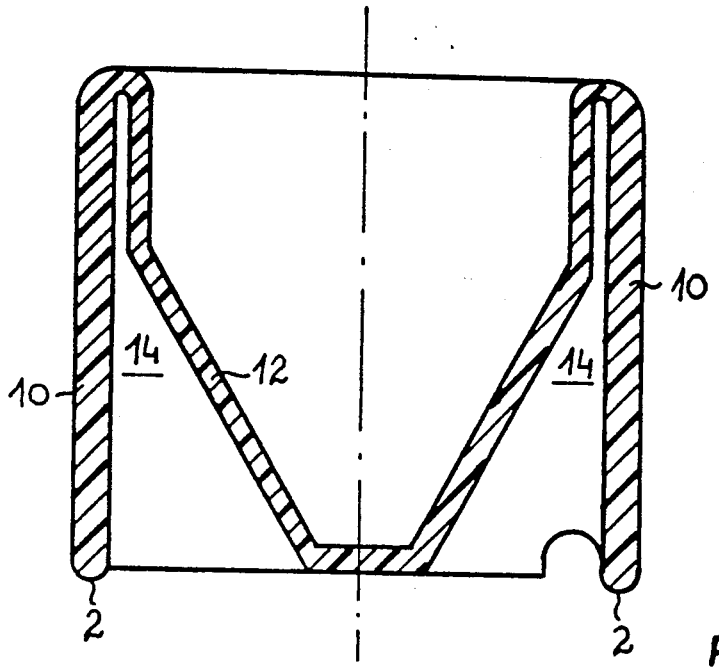
FIG. 2 is an enlarged cross-sectional view of FIG. 1 at AA.
Figure 3:
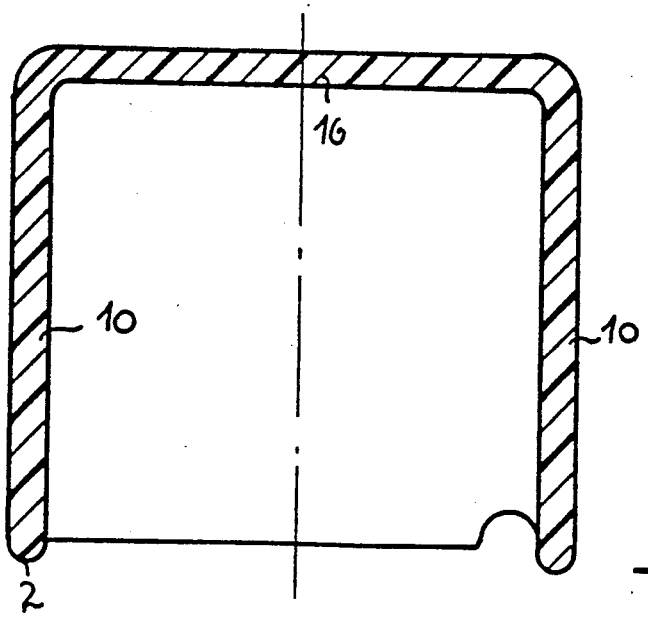
FIG. 3 is a cross-sectional view of FIG. 1 at BB.
Figure 4:
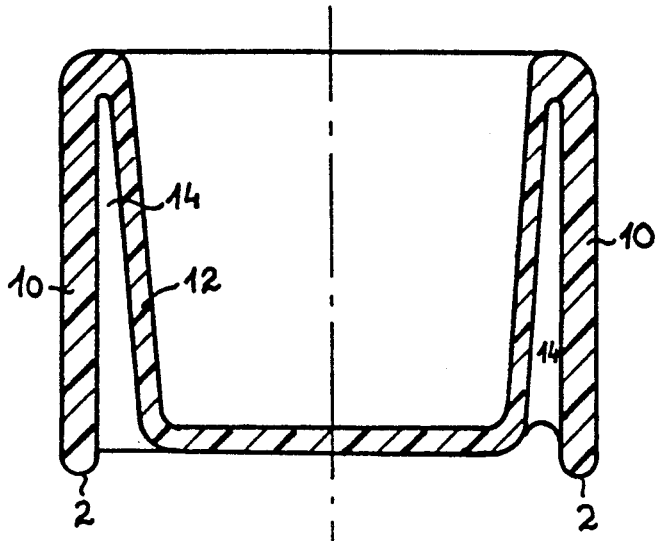
FIG. 4 is a cross-sectional view of FIG. 1 at CC.

Referring now to the drawings, there is seen in FIG. 1 an arcuate rail-like rocker, its lower surface 2 being convex, and the radius of curvature being several times larger than the overall length of the rocker. The rocker is composed of an end zone 4 (see also FIG. 2), a central zone 6 (see FIG. 3) and a plurality of recesses 8 which form the second end zone. Two side walls 10 extend along and join all three zones. In FIGS. 2 and 4 the section 12 between the side walls is U shaped and inwardly tapered. The spaces 14 shown between the U-shape section 12 and the side walls 10 may be hollow when the material of manufacture is a solid plastic. However, when the material of manufacture is a foamed plastic, the spaces 14 may be filled. FIG. 3 shows the central zone in cross section, an upper wall 16 joining the side walls 10 to form an unverted U. The side walls 10 are joinea by two end walls 18.

Figure 5:
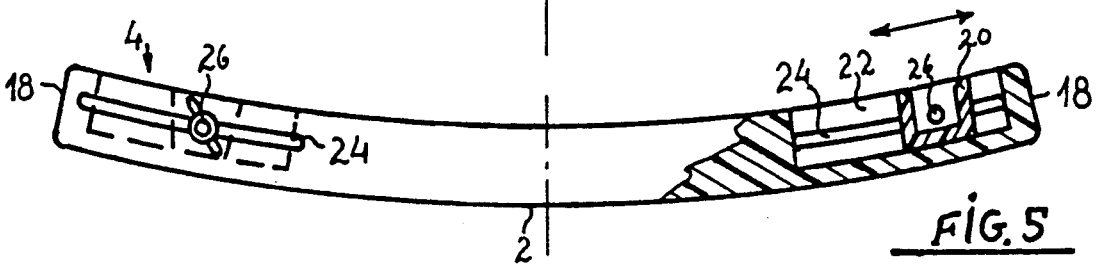
FIG. 5 is a front elevation, partially sectioned, of a second embodiment of the invention providing furniture leg clamp means.
Figure 6:
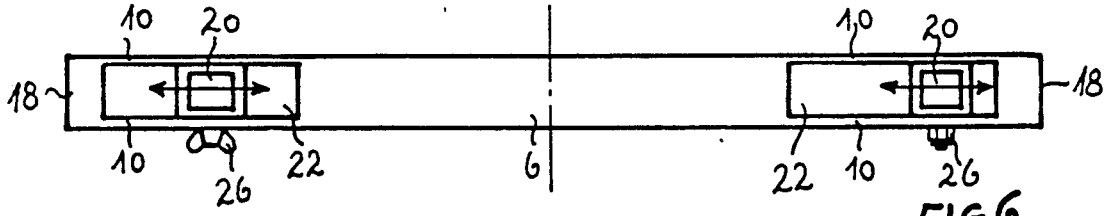
FIG. 6 is a plan view of FIG. 5.

A second embodiment of the invention is shown in FIGS. 5 and 6, wherein two receptacles 20 are slidably mounted, one in each zone, each receptacle 20 being mounted in an elongated recess 22. Receptacles 20 are sized to allow the insertion of a furniture leg or of the castor attached to the extremity of the leg. Slots 24 and clamping means 26 allow for the locking of the receptacle 20 in any location inside the recess 22.

Figure 7:
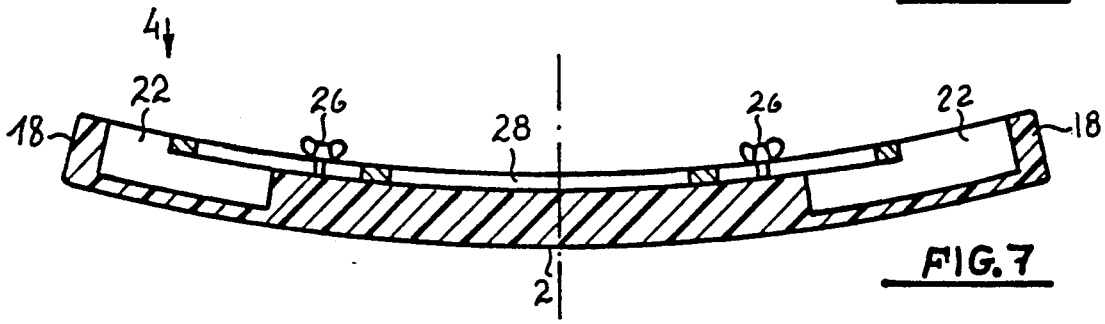
FIG. 7 is a longitudinal cross-section of a third embodiment, showing different furniture leg clamp means.
Figure 8:
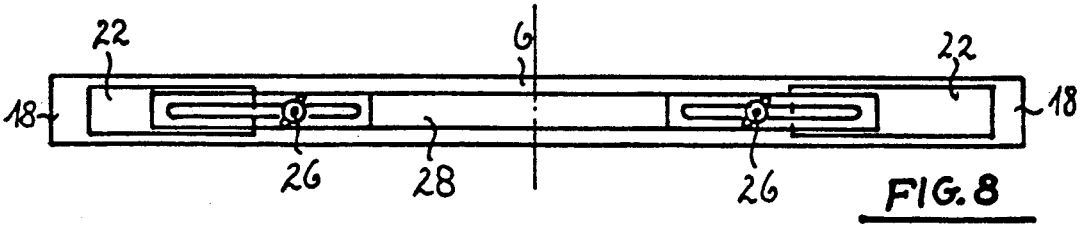
FIG. 8 is a plan view of FIG. 7.
Figure 9:
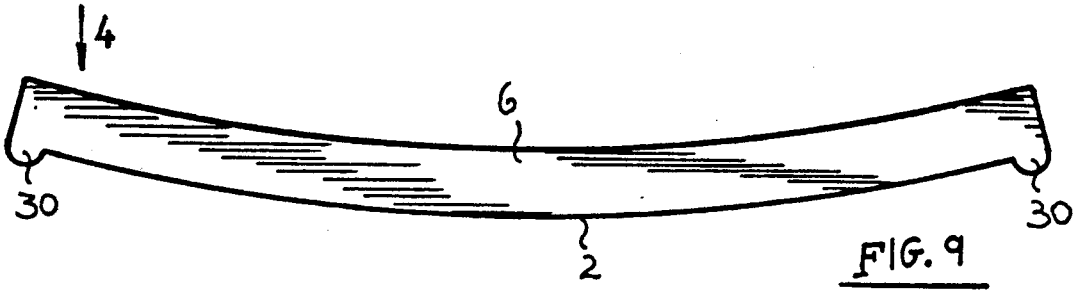
FIGS. 9, 10 and 11 are front elevations of further embodiments, wherein different fixed means are shown which delimit the traverse of the rocker.
Figure 10:
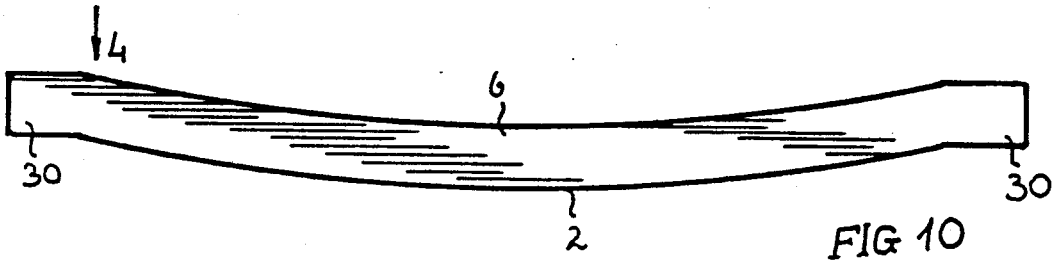
Figure 11:
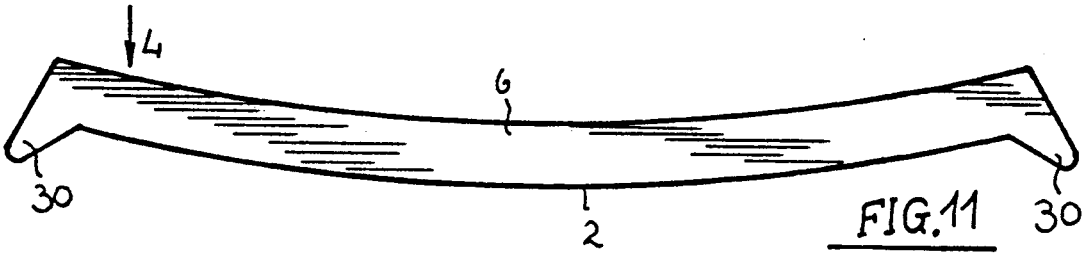

FIGS. 7 and 8 show a third embodiment of the rocker, provided with furniture leg clamp means in the form of a channel 28, in which there is slidingly held clamp means 26. Two recesses 22 are provided, one in each end zone, and are sized to allow the insertion of a furniture leg. FIGS. 9, 10, and 11 show further embodiments of the invention, wherein downwardly facing projections 30 form the termination of lower surface 2. The other details of the rocker are as previously described with reference to FIGS. 1 to 8.

Figure 12:
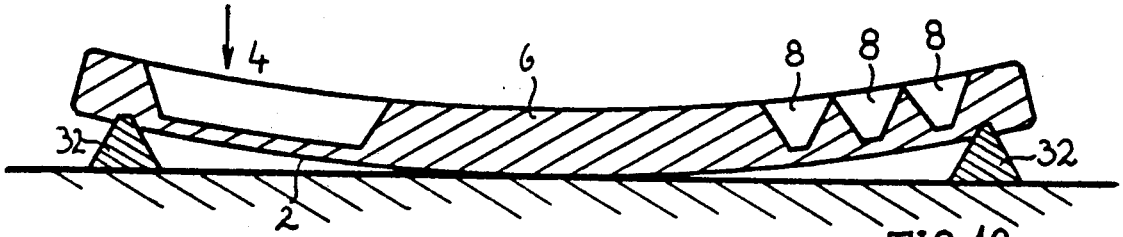
FIG. 12 is a cross-sectional elevation of a further embodiment, wherein removable means are provided and in use to prevent rocking.
Figure 13:
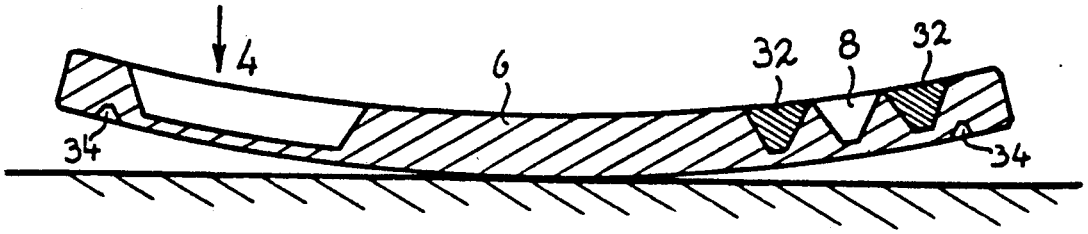
FIG. 13 is a cross-sectional elevation of the embodiment of FIG. 12, wherein the means provided to prevent rocking are not in use and are stored in the body of the rocker.

A further embodiment of the invention is shown in FIGS. 12 and 13. Two truncated pyramidal legs 32 are provided. Two recesses 34, one near each extremity of lower surface 2, are configured to match the narrow top edge of legs 32, the height of legs 32 being sufficient to prevent rocker movement when inserted in recesses 34. Two of the recesses 8 provide a convenient storage space for legs 32 when the latter are not in use, while a remaining recess 8 functions to support a furniture leg.

Figure 14:
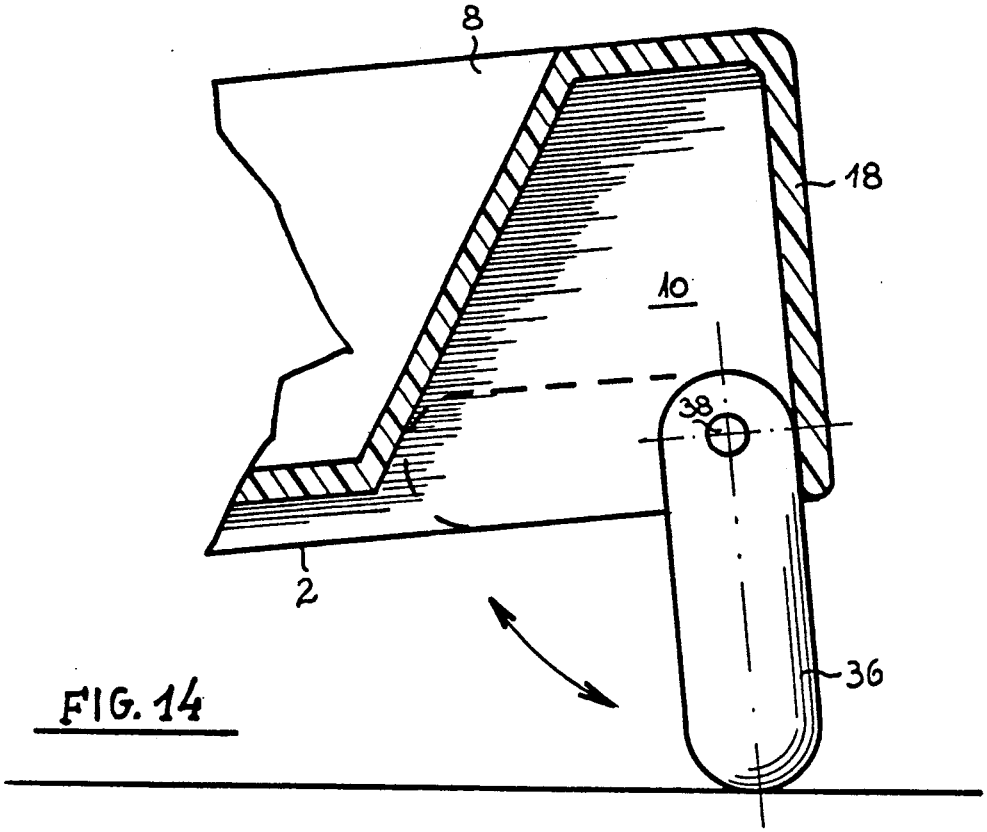
FIG. 14 is a fragmented front elevation of a further embodiment, wherein a stabilizing leg is hinged to the body of the rocker.

FIG. 14 shows a further embodiment of the invention, wherein downwardly extendable retractable stabilizing legs 36 are hinged to a side wall 10 by means of a hinge 8, one leg 36 near each extremity of lower surface 2. When fully extended, leg 36 abuts end wall 18 and is supported thereby, the length of legs 36 being sufficient to prevent, when extended, any movement of the rocker. When retracacted, the whole of leg 36 is above the arc formed by lower surface 2.

Figure 15:
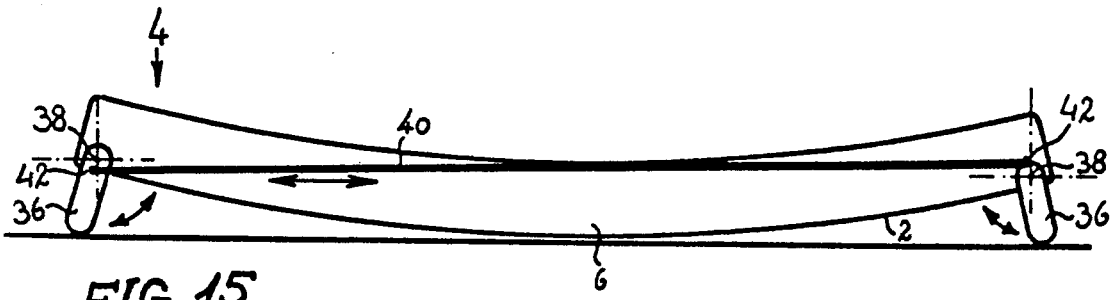
FIG. 15 is a front elevation of a rocker provided with interlinked stabilizing legs.

Yet a further embodiment is shown in FIG. 15, which also is provided with two downwardly extendable and retractable stabilizing legs 36. Additionally an interlinking member 40 is provided, being hingedly connected to both legs 36. On one leg 36 the interlinking connection point 42 is between hinge 38 and the lower extremity of the leg 36, while on the second leg point 42 is on the side of hinge 38 opposite to the lower extremity of leg 36. The result of this arrangement is that the extension or retraction of one leg 36 causes a similar movement in the remaining leg 36.

Figure 16:
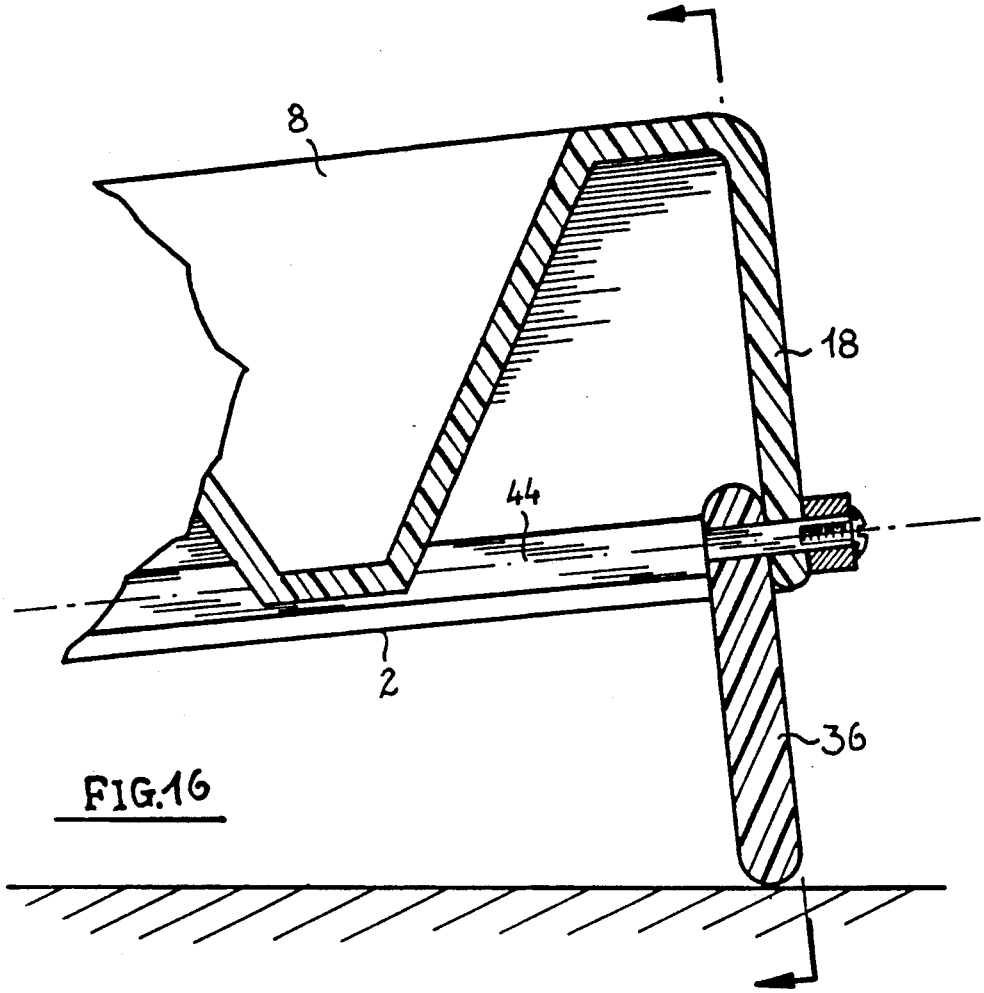
FIG. 16 is a fragmentary section of further embodiment of a rocker provided with interlinked, stabilizing legs.
Figure 17:
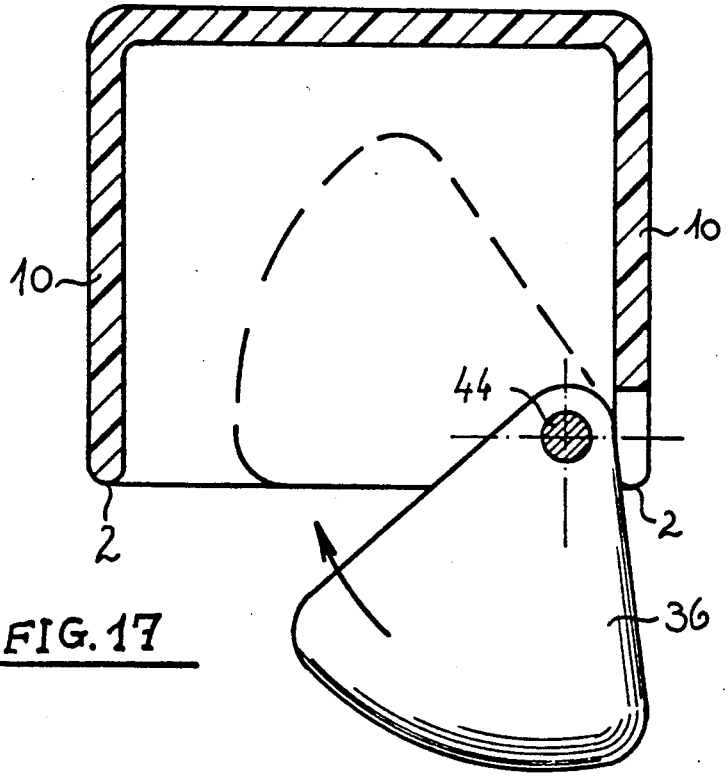
FIG. 17 is an end view of the rocker and leg shown in FIG. 16.

FIGS. 16 and 17 show a further embodiment of the extendable and retractable eccentric legs 36, which here are mounted on a long rod 44, which extends through both end walls 18 and is free to revolve therein. However, both legs 36 are rigidly attached to rod 44, whereby the retraction or extension of one leg 36 causes a quarter turn in rod 44 and thereby the retraction or extension of the remaining leg 36.

Figure 18:
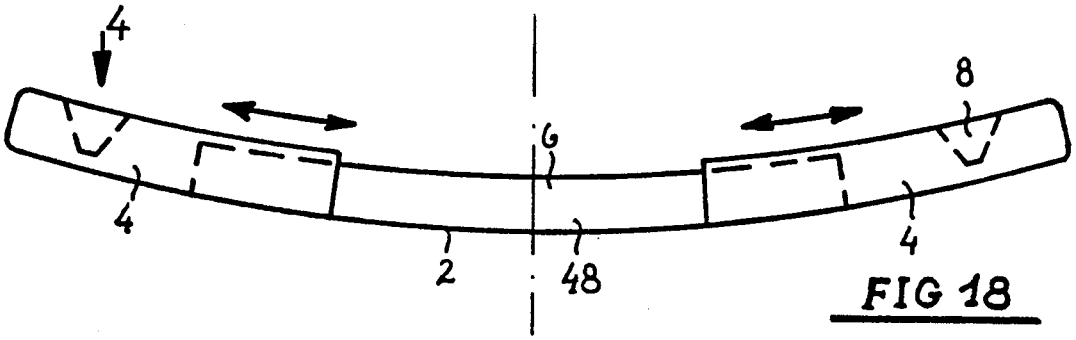
FIG. 18 is a front elevation of an embodiment of the rocker composed of three interlocking segments.
Figure 19:
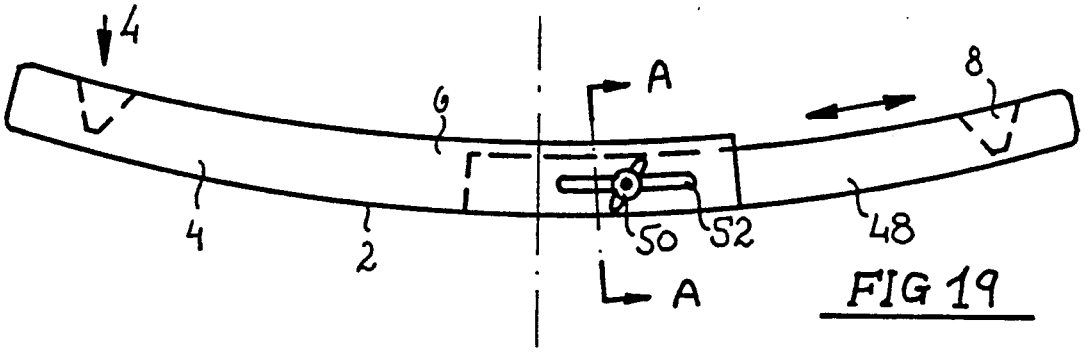
FIG. 19 is as FIG. 18, but for two segments.
Figure 20:
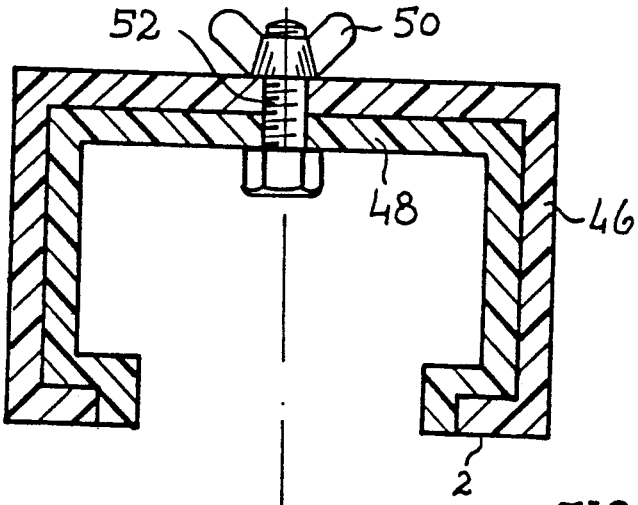
FIG. 20 is an enlarged, cross-sectional view at AA of FIG. 19.

FIGS. 18, 19 and 20 illustrate a rocker composed of two or three telescopically interconnected curved segments, comprising at least one outer member 46 and one inner member 48, the latter being free to slide axially in the former. Locking means 50 project through slot 52, whereby the user may alter and lock the rocker at a length suitable for the leg spacing of the furniture to be used. Only one recess 8 is provided, as only one is needed.

Figure 21:
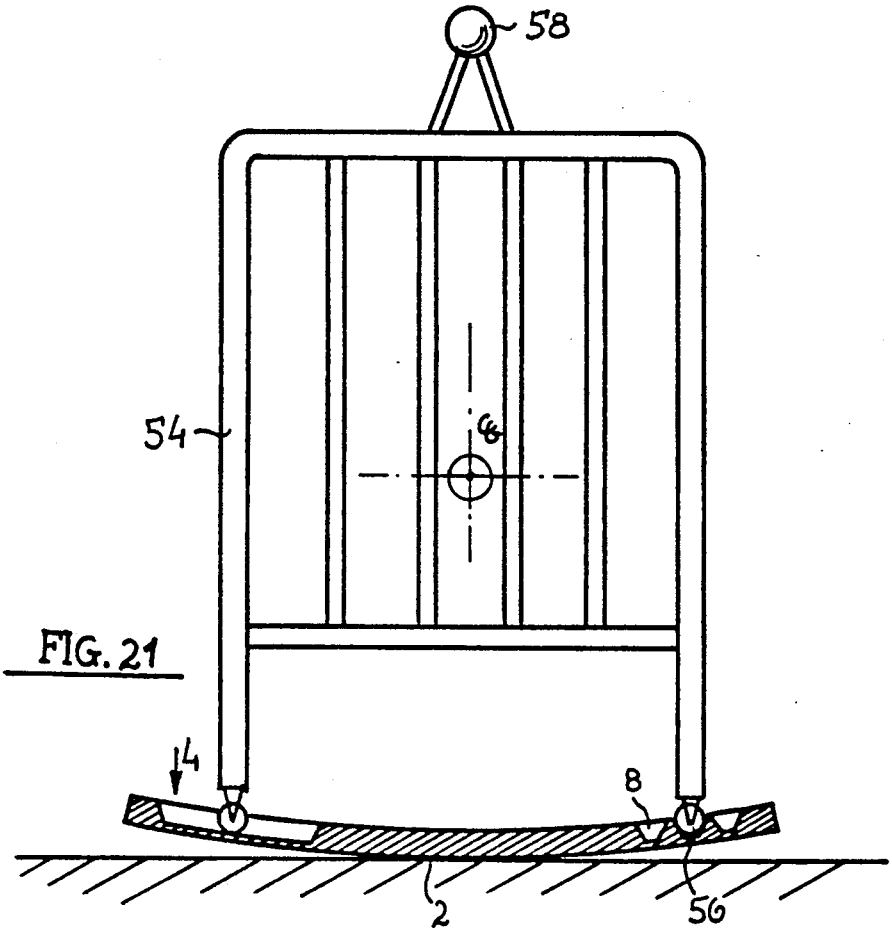
FIG. 21 is a view of the rocker in association with a crib and inertia enhancing weight.
Figure 22:
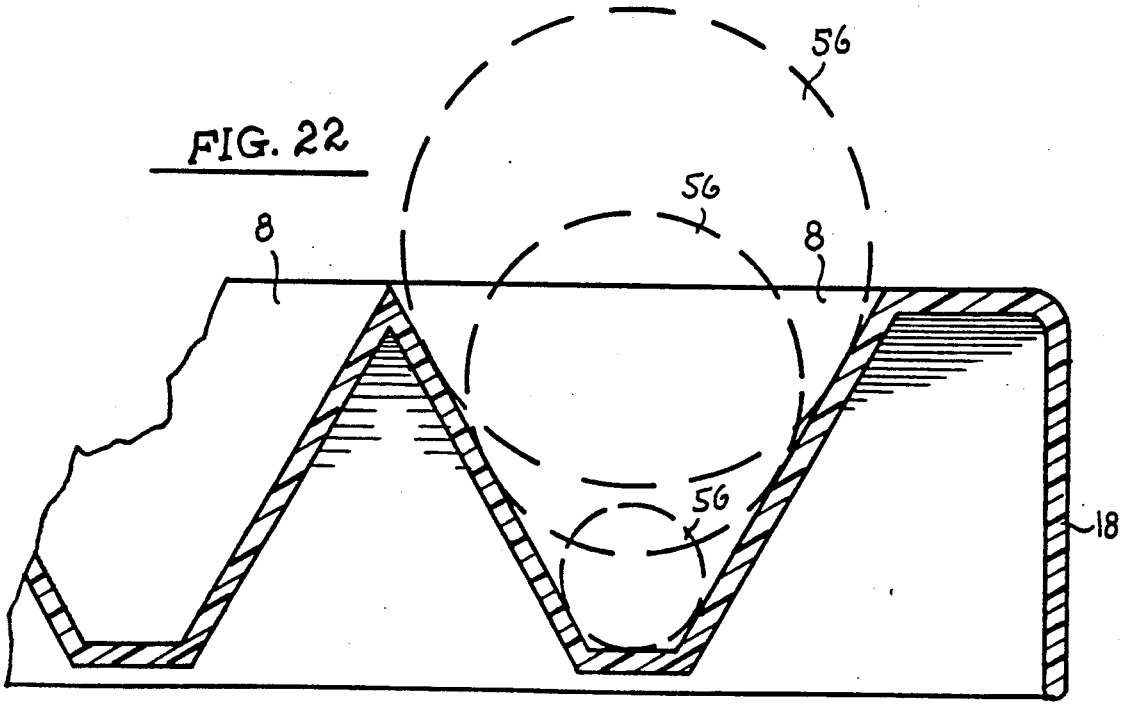
FIG. 22 is an enlarged fragmentary view of a rocker end zone in association with furniture castors of various diameters.

FIG. 21 illustrates the invention in use in association with a crib 54, fitted with castors 56. The 'V' shaped form of recess 8 provides secure location for a castor 56 of any normally used diameter, as can best be seen in FIG. 22, while the elongated recess provided in end zone 4 accepts the remaining leg. An inertia augmenting member 58, supported as high above surface 2 as practical may take the form of a heavy rod supporting mosquito netting. Once set in motion, the energy stored by the displacement of rod 58 from its central equilibrium position will ensure that the rocking crib will continue in motion unattended for a considerable while.

A suitable material for the manufacture of the rocker is a strong, tough thermoplastic, such as ABS or Polycarbonate. As has been previously mentioned, it is alternatively suitable to manufacture the rocker using a rigid structural thermoplastic foam composed of framed polyurethane, reinforced polyester, high density Polyethylene or Polyproplene, for example. A further suitable material for the rocker is wood, which offers the advantages of pleasing appearance and low tooling cost for the manufacturer.

Obviously motor means known per se can be attached to the rocker to effect the gentle rocking of furniture provided therewith.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. Apparatus for converting a crib having generally vertically extending legs into a rocking cradle, said apparatus comprising:

first and second generally arc shaped members each having a generally convex bottom surface adapted for rocking motion, each of said generally arc shaped members being formed with first and second crib leg receiving recess means, said first crib leg receiving recess means comprising at least one first leg receiving recess configured to removably receive the leg of a crib and to releasably retain it in substantially non-slidable relationship relative to the arc shaped member along the arc thereof, said second crib leg receiving recess means comprising at least one second leg receiving recess which is substantially wider than said first leg receiving recess along said arc, thereby to accomodate cribs having varying separations between the legs thereof.

2. Apparatus according to claim 1 and wherein at least one of said first leg receiving recesses is inwardly tapered.

3. Apparatus according to claim 1 wherein at least one of said first leg receiving recesses is associated with clamping means for releasably retaining a leg inserted therein.

4. Apparatus according to claim 1 and also comprising means operatively associated with said are shaped member for selectably preventing rocking of said arc shaped members along said arc.

5. Apparatus according to claim 4 and wherein said means for selectably preventing rocking comprise selectably positionable protrusions.

6. Apparatus according to claim 5 and wherein said selectably positionable protrusions are each pivotably mounted at an end of said arc shaped member.

7. Apparatus according to claim 6 and also comprising connecting means for linking said selectably positionable protrusions whereby pivoting of one of said protrusions causes pivoting of the other protrusion.

8. Apparatus according to claim 1 and wherein said arc shaped members are integrally molded of a plastic material.

* * * * *